US005848695A

United States Patent [19]

Harris et al.

[11] Patent Number: 5,848,695

[45] Date of Patent: Dec. 15, 1998

[54] SIDE-LOADING BASKET CARRIER

[75] Inventors: Randall L. Harris, Powder Springs; Robert L. Sutherland, Kennesaw, both of Ga.

[73] Assignee: Riverwood International Corporation, Atlanta, Ga.

[21] Appl. No.: 908,298

[22] Filed: Aug. 7, 1997

[51] Int. Cl.[6] ..... B65D 75/00

[52] U.S. Cl. ..... 206/427; 206/193; 206/170; 206/434; 206/200; 229/182.1; 229/120.17; 229/103.2

[58] Field of Search ..... 206/200, 198, 206/193, 162, 170, 427, 434; 229/182.1, 120.17, 117.14, 103.2

[56] References Cited

U.S. PATENT DOCUMENTS

| | | | |
|---|---|---|---|
| Re. 29,063 | 12/1976 | Graser | 206/141 |
| 2,445,202 | 7/1948 | Belanger | 229/52 |
| 2,718,997 | 9/1955 | Shuxteau | 229/27 |
| 2,794,572 | 6/1957 | Goss | 220/118 |
| 4,034,852 | 7/1977 | Forrer | 206/141 |
| 4,047,610 | 9/1977 | Stout et al. | 206/187 |
| 4,240,546 | 12/1980 | Stone | 206/193 |
| 4,327,829 | 5/1982 | Hughes | 206/193 |
| 4,955,531 | 9/1990 | Graboyes | 229/182.1 |
| 5,611,425 | 3/1997 | Holley, Jr. | 206/144 |
| 5,680,930 | 10/1997 | Stone | 206/173 |
| 5,695,051 | 12/1997 | Hart | 206/198 |
| 5,709,298 | 1/1998 | Harris | 206/198 |

*Primary Examiner*—Larry I. Schwartz
*Assistant Examiner*—Trinh Nguyen

[57] ABSTRACT

A basket-style carrier which is loaded through open ends. End panel forming flaps are connected to the edges of a central handle panel and end panel flaps are connected to the edges of bottom panel sections on either side of the handle panel. After loading articles through an open end of a partially formed carrier, the end panel forming flaps are folded and the end panel flaps are adhered to them. Gusset panels connect the end panel flaps to the end panel forming flaps. The handle panel is of two-ply construction with a four-ply handle area.

6 Claims, 4 Drawing Sheets

SIDE-LOADING BASKET CARRIER

FIELD OF THE INVENTION

This invention relates to basket-style carriers for carrying articles such as beverage bottles. More particularly, it relates to a basket-style carrier designed to be loaded from the side, through open ends, rather than from the top.

BACKGROUND OF THE INVENTION

Basket-style carriers are commonly employed to package beverage bottles. A conventional arrangement includes opposite side panels spaced from a center handle partition to form an article receiving area on each side of the handle partition. Normally, the carriers are fabricated from a blank which is folded and glued into collapsed carrier form, after which the collapsed carrier is erected and loaded. When dealing with carriers in which the bottom panel is preformed, the bottles are dropped into the carrier from above. When dealing with carriers in which the bottom panel is formed after loading, the carrier is moved down over the bottles prior to forming the bottom panel. Although both methods provide an adequate way to introduce bottles into basket carriers, these loading methods are relatively slow compared to the loading of sleeve-type carriers, wherein the bottles are pushed through the open ends of carrier sleeves, after which the end panels are closed.

Another problem with basket carriers is the difficulty of designing a carrier to hold large numbers of bottles. When designed to carry four to eight bottles, the finished package is strong and easy to carry, providing sufficient rigidity so that when picked up and carried there is no sagging or other suggestion of weakness. Problems of rigidity arise, however, when greater numbers of bottles, for example twelve, are packaged in a carrier of conventional design. The length of the carrier must be extended to such an extent that the carrier can give an impression of flimsiness when picked up, even though it may have sufficient strength to support the load. This could be reduced somewhat by forming the carrier from thicker paperboard stock, but that would increase the cost of the carrier and still would not entirely overcome the inherent tendency of an elongated carrier to feel less than rigid when lifted and carried.

It would be highly desirable to provide a basket carrier which can be loaded more quickly than the conventional methods discussed. It would also be desirable to provide a basket carrier capable of holding large numbers of bottles or other articles which is not only strong enough to support the load but provides a feeling of rigidity when lifted and carried.

BRIEF SUMMARY OR THE INVENTION

The invention is incorporated in a basket-style carrier which comprises opposite side panels connected to a bottom panel, opposite end panels connected to the side panels and a centrally located handle panel extending substantially parallel to the side panels. End panel forming flaps connected to the end edges of the handle panel are adhered to end panel flaps connected to the end edges of the bottom panel to form the end panels. This arrangement allows the carrier blank to be partially formed to a point wherein the handle panel and spaced side panels extend upwardly while the end panels are open, thereby allowing bottles or other articles to be moved into place through the open ends rather than being dropped into a fully formed carrier.

In a preferred arrangement the end panels include gusset panels connecting the end panels and the end panel forming flaps. With this arrangement the end panel forming flaps are automatically folded into place when the end panel flaps are pivoted down during the carrier forming process. Also, the end panel flaps in each end panel are overlapping, one of them being longer than the other. The end panel forming flaps include notched areas adjacent the bottom panel to enable the longer end panel flap to pivot to their final position.

The handle panel is of two-ply construction and the handle area may be of four-ply construction, made possible by the use of handle reinforcement flaps. Additionally, the end panels may include elongated end portions which curve around the corner articles to form rounded carrier corners.

These and other features and aspects of the invention will be readily ascertained from the detailed description of the preferred embodiment described below.

DETAILED DESCRIPTION OF THE PREFERRED EMBODIMENT

Figure 1:
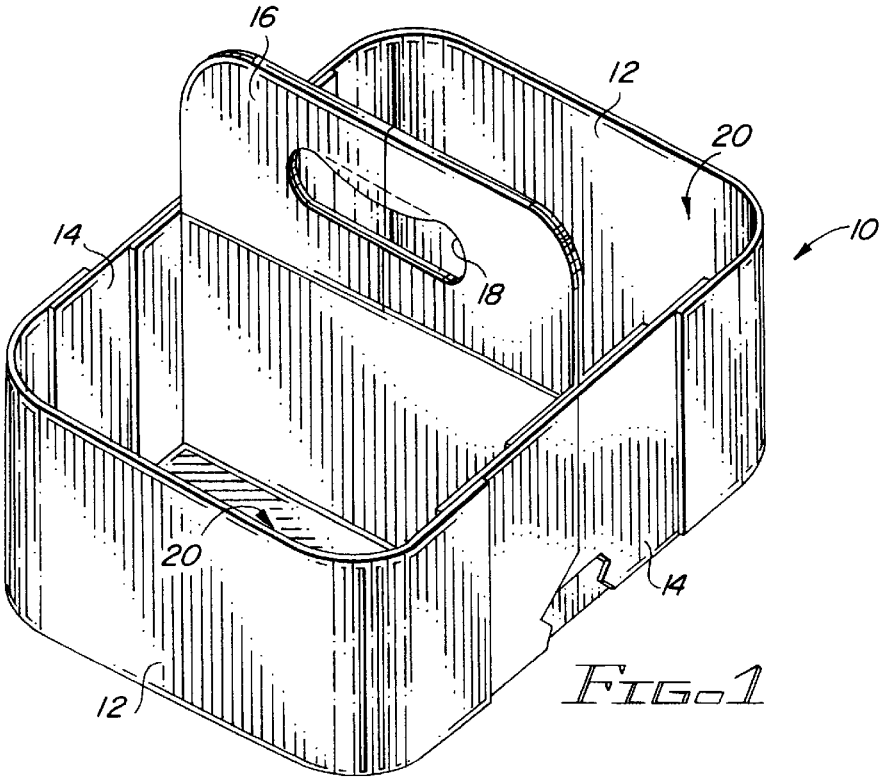
FIG. 1 is a pictorial view of a basket-style carrier incorporating the features of the invention.

Referring to FIG. 1, the basket-style carrier 10 of the invention includes opposite side panels 12 connected to opposite end panels 14. Extending between the end panels 14 substantially parallel to the side panels 12 is a centrally located handle panel 16 containing handle opening 18. This arrangement forms article-receiving areas 20 on each side of the handle panel 16. The corners of the carrier are rounded so as to fit snugly about the rounded barrels of packaged beverage bottles.

Figure 2:
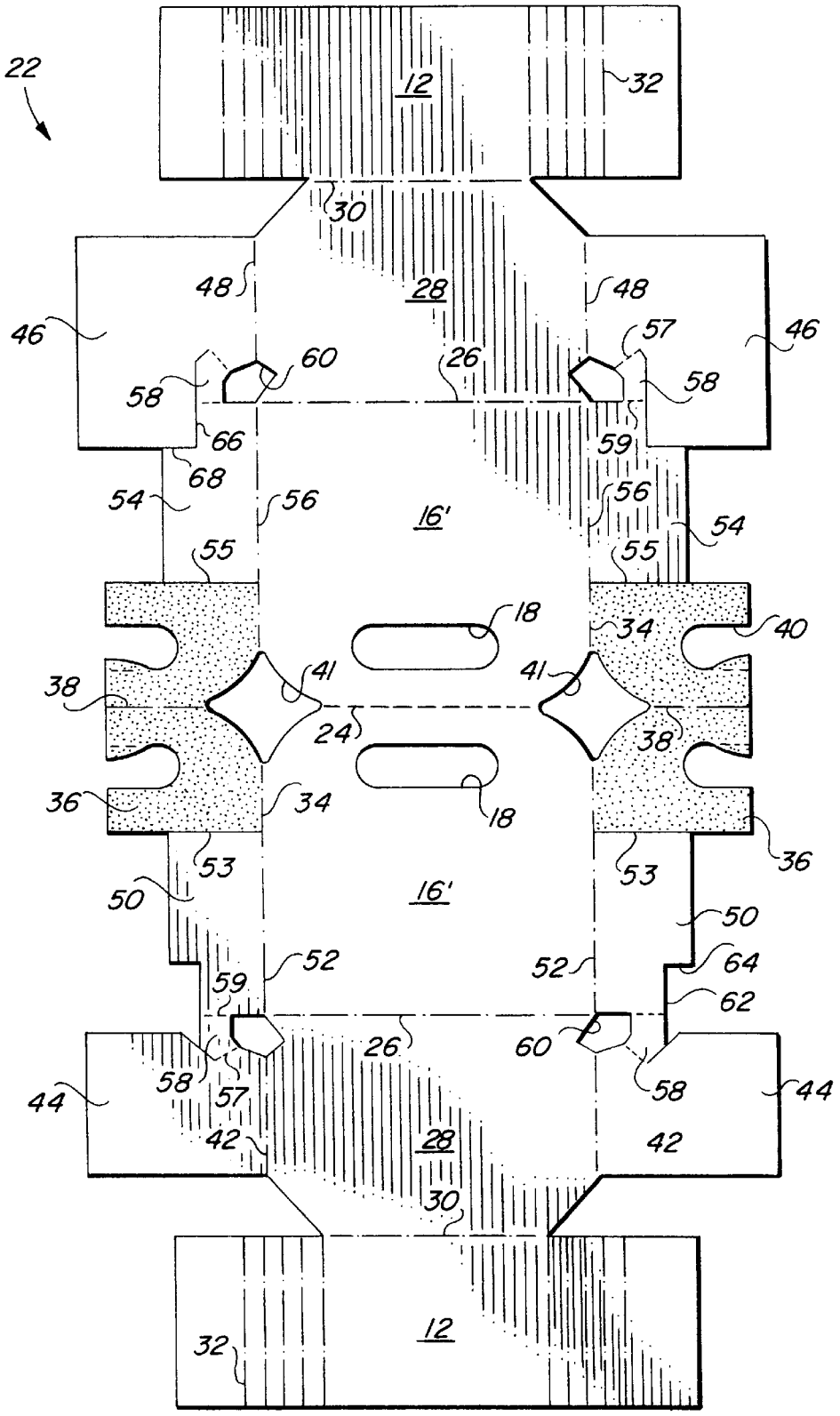
FIG. 2 is a plan view of a blank for forming the carrier.

Referring to FIG. 2, wherein like reference numerals to those used in FIG. 1 denote like elements, a blank 22 for forming the carrier 10 is illustrated. Preferably, the blank is formed from paperboard of the type conventionally used in the carrier industry. Two similar handle panel plies 16' are connected by fold line 24, and each is connected by a fold line 26 to a bottom panel section 28. Side panel flaps 12, containing parallel score lines 32, are connected to the bottom panel sections 28 by fold lines 30. The fold lines 24, 26 and 30 are parallel.

Connected to the upper end edges of the handle panel plies 16' by fold lines 34 are two pairs of handle reinforcing flaps 36. The flaps of each pair are connected to each other by fold line 38, which is aligned with the center fold line 24, and each flap 36 contains a partial handle opening 40. The fold lines 34 are interrupted by cutouts 41, which also separate the fold lines 24 and 38. These cutouts provide for the rounded upper corners of the handle panel plies. Connected by fold lines 42 to the end edges of one of the bottom panel sections 28 are end panel flaps 44. End panel flaps 46 are connected to the end edges of the other bottom panel section by fold lines 48. Located between the handle panel reinforcement flaps 36 and the end panel flaps 44 are end panel forming flaps 50, which are connected to the end edges of the adjacent handle panel ply 16' by fold lines 52 and are separated from the handle reinforcing flaps 36 by slits 53. Similarly, end panel forming flaps 54 are connected to the end edges of the other handle panel ply 16' by fold lines 56 and are separated from the handle reinforcing flaps 36 by slits 55.

Gusset panels 58, connected to the end panel flaps 44 and 46 by fold lines 57 and to the end panel forming flaps 50 and 54 by fold lines 59, further connect the end panel flaps 44 to the end panel forming flaps 50 and the end panel flaps 46 to the end panel forming flaps 54. Adjacent cutouts 60 are defined by edge portions of the end panel flaps, the gusset panels, the end panel forming flaps and the bottom panel sections. The cutouts do not extend into the handle panel plies but connect with their adjacent lower corners. It will be noted that the end panel flaps 46 are longer than the end panel flaps 44, but the end panel forming flaps 50 and 54 are of the same size and shape. Each end panel forming flap includes a notched portion, formed in the case of the forming flaps 50 by edges 62 and 64 and in the case of the forming flaps 54 by the slits 66 and 68. In the latter case the slits 66 and 68 separate the extended portion of the end panel flaps 46 from the end panel forming flaps 54.

To form a collapsed carrier from the blank 22 adhesive is first applied to the surface of the handle reinforcement flaps 36 facing the viewer, as shown in stipple in FIG. 2, after which the reinforcement flaps are pivoted about fold lines 34 and adhered to the handle panel plies 16'. The fold lines 38 overlie the fold line 24 after this operation. Adhesive is then applied to the surface of the handle panel plies 16' facing away from the viewer, and the blank is folded about the combined fold lines 24 and 38 to form the collapsed carrier shown in FIG. 3. In this form the end panel forming flaps 50 and 54 overlie each other and are aligned. The end panel flaps 44 and 46 also overlie each other, but the portions of the longer end panel flaps 46 extending up beyond the shorter end panel flaps 44 are visible.

Figure 3:
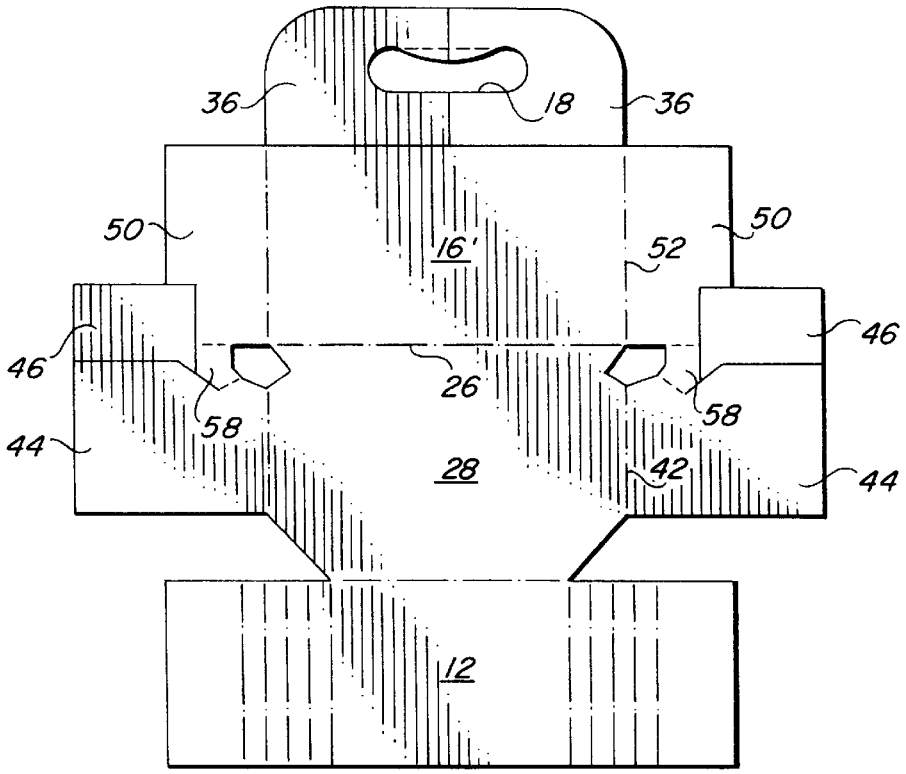
FIG. 3 is a plan view of the carrier blank after initial folding and gluing steps have been performed.
Figure 4:
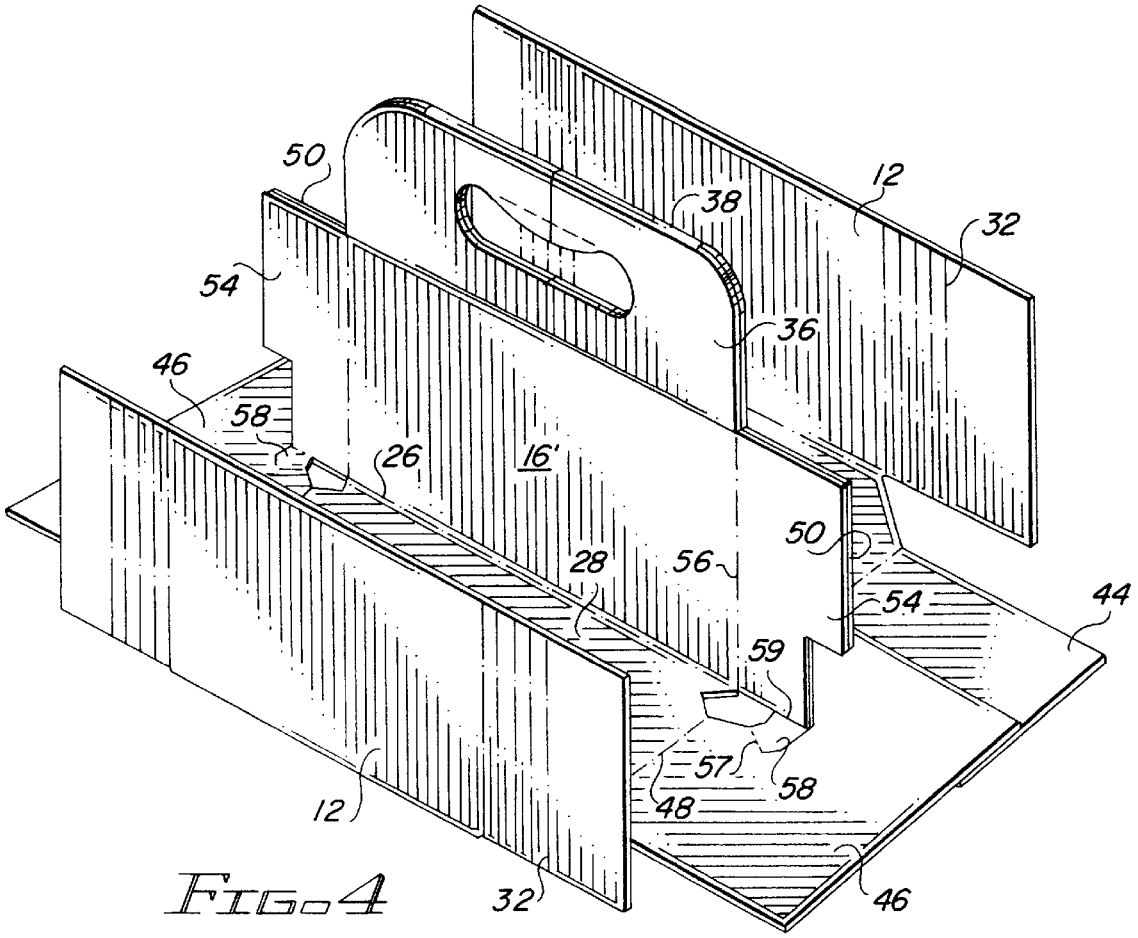
FIG. 4 is a pictorial view of an opened carrier blank prior to being loaded.

When ready to load bottles into a carrier the collapsed carrier of FIG. 3 is opened to the form shown in FIG. 4 by folding the bottom panel sections 28 out from the handle panel 16 and the side panel flaps 12 up from the bottom panel sections. In this condition the end panel forming flaps 50 and 54 remain in the same plane as their associated handle panel plies 16' and the end panel flaps 44 and 46 remain in the same plane as the bottom panel sections 28. To reach these positions the end panel flaps 44 and 46 will have moved through an angle of 90° with respect to the end panel forming flaps 50 and 54 when the bottom panel sections 28 were folded into the position shown. This movement is made possible by the notches in the end panel forming flaps 50 and 54 which permit the longer end panel flaps 46 to move past the end panel forming flaps 50 and 54 without interference or binding. During this pivoting movement the longer end panel flaps 46 partially overlap the shorter end panel flaps 44. The gusset panels 58, lying in the same plane as the end panel flaps 44 and 46, remain unfolded.

Figure 5:
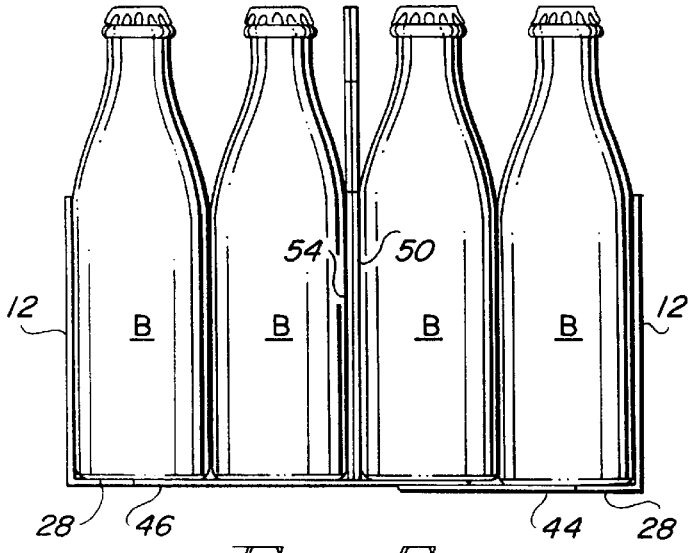
FIG. 5 is an end view of the opened carrier blank after being loaded.
Figure 6:
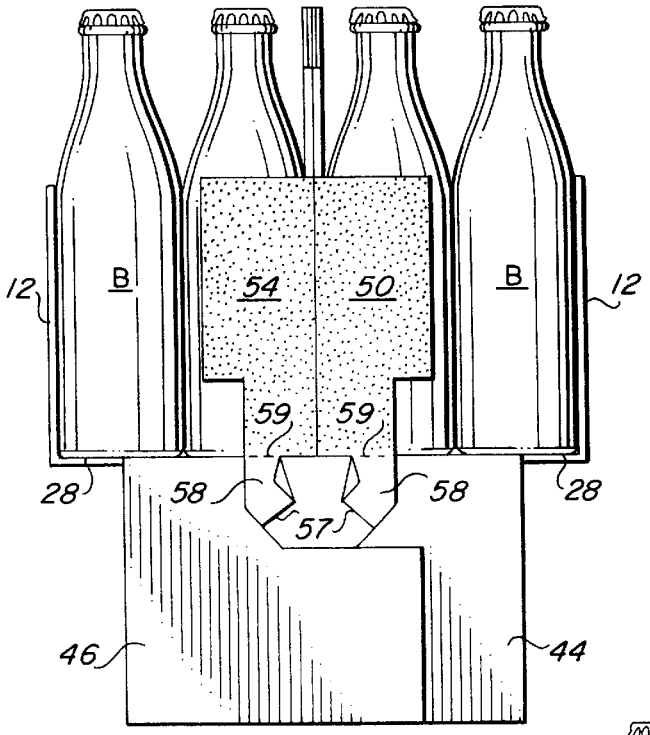
FIG. 6 is an end view similar to that of FIG. 5, but after a preliminary folding step of the end panel has been carried out.

Bottles are then moved into the opened interim form of carrier shown in FIG. 4, typically by sliding them in through one or both open ends. FIG. 5 shows the interim form of carrier after it has been loaded, the illustrated carrier containing twelve bottles arranged in four rows of three each. After the bottles have been introduced the end panel flaps 44 and 46 are pivoted down. As the end panel flaps move downwardly the gusset panels move with them, causing the end panel forming flaps 50 and 54 connected to the gusset panels to pivot outwardly about the fold lines 52 and 56, as illustrated in FIG. 6. Glue is then applied to the end panel forming flaps, as shown in stipple in FIG. 6, and the end panel flaps 44 and 46 are folded up against the forming flaps to adhere the end panels, including the gusset panels, in place. The carrier at this stage of the forming operation is shown in FIG. 7.

Figure 7:
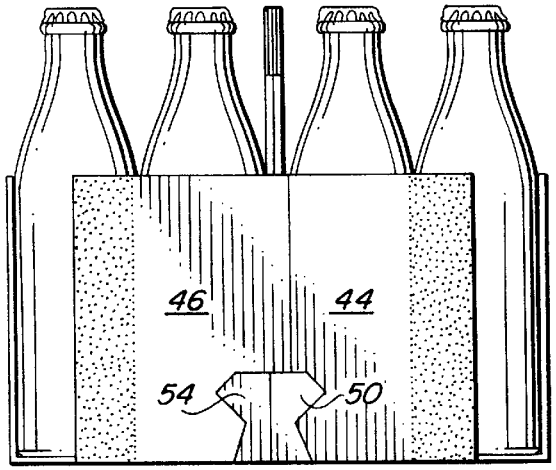
FIG. 7 is an end view similar to that of FIG. 6, but after a second end panel folding step has been carried out.
Figure 8:
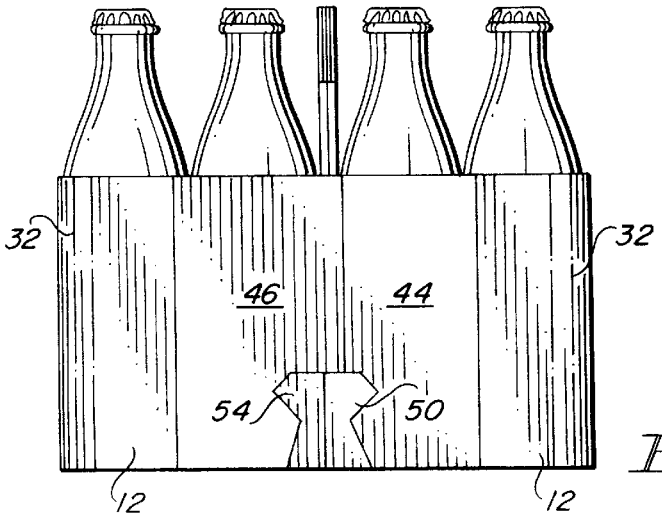
FIG. 8 is an end view of the finished basket carrier package.

To complete the carrier, glue is applied to either the end portions of the side panel flaps or to the side portions of the end panel flaps, the latter of which is illustrated by the stippling in FIG. 7. The end portions of the side panel flaps are then tightly wrapped around the corner bottles and adhered to the end panel flaps. The completed package is illustrated in FIG. 8. The score lines 32 in the end portions of the side panel flaps 12 enable the flaps to smoothly and tightly contact the rounded surfaces of the corner bottles in the package.

Because the side and end panels of the carrier so snugly hold the bottles in place, there is little risk of bottle movement within the carrier. Dividers for separating the bottles from each other therefore need not be used. Of course, if extra precaution against the risk of bottle movement and possible breakage is desired, butterfly dividers can readily be employed as is known in the art. Although the preferred embodiment of the invention employs rounded corners, the basic elements of the invention may be used in connection with a carrier having beveled corners instead, in which case the use of bottle dividers would be more likely.

It will be appreciated that the carrier units and the carrier itself are relatively simple and economical to produce and form. The carrier is very strong and rigid, enabling it to hold large numbers of bottles without sagging, or giving the impression of sagging, when lifted. The handle panel is of two-ply construction and the handle grip area, with the handle reinforcement flaps in place, is of four-ply construction. Although this is the preferred design, for carriers not needing extra reinforcement in the handle area, the reinforcement flaps may be omitted.

Forming and loading of the carrier may be carried out by hand or by automatic packaging machines, as is well known in the industry. While the invention has been described in connection with the packaging of beverage bottles, it will be understood that the carrier could be designed to hold other types of articles as well.

It is contemplated that the invention need not necessarily be limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A basket-style article carrier, comprising:

opposite side panels connected to a bottom panel;

opposite end panels connected to the side panels;

a centrally located handle panel extending substantially parallel to the side panels, the handle panel having opposite end edges;

end panel forming flaps connected to the end edges of the handle panel, the end panels being adhered to associated end panel forming flaps, said end panels being connected to opposite edges of the bottom panel and said end panels include gusset panels foldably connected to both the end panels and the end panel forming flaps;

each end panel is comprised of two overlapping end panel flaps, one of the end panel flaps being longer than the other end panel flap; and said end panel forming flaps include notched areas adjacent the bottom panel, the notched areas extending upwardly a distance such that when the end panel forming flaps and the end panel flaps lie in substantially the same plane as the handle panel during formation of the carrier, the longer end panel flap is free to pivot through the notches to a plane substantially at right angles to the end panel forming flaps.

2. A basket-style article carrier as defined in claim 1, wherein the handle panel includes a handle area, the handle panel being of two-ply construction and the handle area being of four-ply construction.

3. A basket-style article carrier as defined in claim 1, wherein the carrier includes four corners and the end panels include elongated end portions adhered to the side panels, the elongated end portions curving around the corners to form rounded corners.

4. A basket-style article carrier as defined in claim 3, wherein the elongated end portions of the end panels include vertical score lines in the rounded corners.

5. A blank for forming a basket-style article carrier, comprising:

a pair of handle plies connected along a substantially central fold line, each handle ply having opposite end edges extending at substantially right angles to the central fold line, the end edges of handle plies being substantially aligned;

each handle ply being connected to a bottom panel section along a fold line substantially parallel to the central fold line, each bottom panel section having opposite end edges extending at substantially right angles to the central fold line and being substantially aligned with the end edges of the handle plies;

each bottom panel section being connected to a side panel flap along a fold line substantially parallel to the central fold line;

each end edge of the handle plies being connected by a fold line to an end panel forming flap;

each end edge of the bottom panel sections being connected by a fold line to an end panel flap;

the end panel forming flaps being designed to extend parallel to, and in face-to-face contact with, the end panel flaps in a carrier formed from the blank, the end panel flap connected to one of the edges of the associated bottom panel section is longer than the end panel flap connected to the aligned edge of the other bottom panel section;

the end panel forming flaps include notched areas adjacent an associated gusset panel, the notched areas extending a distance such that when the end panel forming flaps and the end panel flaps lie in substantially the same plane as the handle panel plies during formation of the carrier, the longer end panel flaps are free to pivot through the notches to a plane substantially at right angles to the end panel forming flaps; and gusset panels foldably connected to the end panel flaps and associated end panel forming flaps.

6. A blank as defined in claim 5, including handle reinforcement flaps foldably connected to the side edges of the handle panel plies adjacent the end panel forming flaps.

* * * * *